US007520590B2

(12) United States Patent
Hara

(10) Patent No.: US 7,520,590 B2
(45) Date of Patent: Apr. 21, 2009

(54) INKJET RECORDING DEVICE

(75) Inventor: Kohzo Hara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 136 days.

(21) Appl. No.: 11/286,469

(22) Filed: Nov. 23, 2005

(65) Prior Publication Data

US 2006/0262160 A1 Nov. 23, 2006

(30) Foreign Application Priority Data

May 23, 2005 (JP) ..... 2005-150200

(51) Int. Cl.
*B41J 2/21* (2006.01)

(52) U.S. Cl. ..... 347/43; 347/15; 347/100; 347/96

(58) Field of Classification Search ..... 347/15, 347/43, 10, 11, 14, 98, 100, 96; 358/1.2, 358/1.9
See application file for complete search history.

(56) References Cited

U.S. PATENT DOCUMENTS 5,892,524 A * 4/1999 Silverbrook ..... 347/15
6,027,196 A * 2/2000 Gotoh et al. ..... 347/7
6,189,993 B1 * 2/2001 Mantell ..... 347/15
6,439,708 B1 * 8/2002 Kato et al. ..... 347/98
6,445,466 B1 * 9/2002 Derhak ..... 358/1.9
6,550,904 B2 * 4/2003 Koitabashi et al. ..... 347/100
6,601,938 B1 * 8/2003 Iwasaki et al. ..... 347/15
2002/0054178 A1 * 5/2002 Sugimoto et al. ..... 347/15
2004/0061760 A1 * 4/2004 Yano et al. ..... 347/102
2005/0200649 A1 * 9/2005 Yamaguchi et al. ..... 347/21

FOREIGN PATENT DOCUMENTS

JP 58-128862 8/1983
JP 2001-105633 4/2001

* cited by examiner

*Primary Examiner*—Matthew Luu
*Assistant Examiner*—Henok Legesse
(74) *Attorney, Agent, or Firm*—Fildes & Outland, P.C.

(57) ABSTRACT

An inkjet recording device having droplet ejection heads that respectively eject ink liquids of plural colors and a reaction liquid at a recording medium; a preparation section, that prepares dot data representing ejection-amounts of the ink liquids and the reaction liquid for each dot, based on gradation values of each pixel of an image represented by image data, such that ejection-amounts of the ink liquids of some colors, each having high in visibility, are represented by data with a predetermined number of bits, and ejection-amounts of the reaction liquid and the ink liquid of the rest color are represented by data with a number of bits smaller than the predetermined number, and a number of bits of the dot data for one dot is an integer multiple of eight bits; and a control section that controls ejection based on the prepared dot data, is provided.

9 Claims, 9 Drawing Sheets

INKJET RECORDING DEVICE

CROSS-REFERENCE TO RELATED APPLICATION

This application claims priority under 35 USC 119 from Japanese Patent Application No. 2005-150200, the disclosure of which is incorporated by reference herein.

BACKGROUND OF THE INVENTION

1. Field of the Invention

The present invention relates to an inkjet recording device which ejects ink liquids of plural colors and a reaction liquid, which causes a predetermined reaction to occur at the ink liquids, for recording an image at a recording medium.

2. Description of the Related Art

Heretofore, inkjet recording devices ("inkjet printers") have been known which eject ink droplets of plural colors (for example, black (K), cyan (C), magenta (M) and yellow (Y)) from droplet ejection heads to form color images at recording mediums such as paper and the like.

In this kind of inkjet recording device, halftone processing is performed in accordance with gradation values of each of pixels of image data. A pixel may be recorded by plural dots, and image quality of an image may be improved by controlling ejection amounts of ink droplets, which are ejected from the droplet ejection heads to each of the dots constituting the pixel, to, for example, "large droplet", "medium droplet", "small droplet" or "null", to control the sizes of the dots that are recorded. Now, Japanese Patent Application Laid-Open (JP-A) No. 2001-105633 has disclosed, for an inkjet recording device which is capable of recording dots of plural sizes, a technique of recording the color Y with smaller dot sizes, because, in the color Y, streaking and color variation are less conspicuous relative to the colors K, C and M.

Further, at this kind of inkjet recording device, in addition to the ink liquid of each color, a reaction liquid may be provided for, for example, coagulating dye of the ink to prevent running of the ink, or improving coloration characteristics of the ink or the like. In JP-A No. 58-128862, a technique has been disclosed in which this reaction liquid (described as a processing ink in JP-A No. 58-128862) is ejected to overlay an image, improving image quality of the recorded image.

However, in a case of controlling ejection amounts of ink liquids ejected from droplet ejection heads to large droplet, medium droplet, small droplet and nothing, as described above, it is necessary to perform control of the droplet ejection heads with two bits of data (for four values) being prepared for each dot for each color to be recorded. Therefore, in order to eject C, M, Y and K ink liquids and a reaction liquid from the droplet ejection heads for recording a color image, ten bits of dot data are required for each dot, and the data amount for one dot does not constitute a single byte (eight bits). Consequently, it is more difficult to perform various kinds of digital processing on the respective dots of the dot data, which is problematic.

SUMMARY OF THE INVENTION

The present invention has been devised in order to address the problem described above, and will provide an inkjet recording device which both suppresses a deterioration of quality of images which are recorded on the basis of dot data and is capable of performing digital processing on respective dots of the dot data with ease.

A first aspect of the present invention is an inkjet recording device having: droplet ejection heads, that respectively eject ink liquids of plural colors and a reaction liquid, for recording dots at a recording medium, the reaction liquid causing a predetermined reaction to occur at the ink liquids; a preparation section, that prepares dot data representing ejection amounts of the ink liquids of the plural colors and the reaction liquid for each dot, on the basis of gradation values of each pixel of an image represented by image data, the preparation section preparing the dot data such that ejection amounts of the ink liquids of colors among the plural colors, each of the ink liquids of the colors being high in visibility, are respectively represented by data with a predetermined number of bits, ejection amounts of the reaction liquid and the ink liquid of the rest of the plural colors are respectively represented by data with a number of bits which is smaller than the predetermined number of bits, and a number of bits of the dot data for one dot is an integer multiple of eight bits; and a control section that controls ejection of the ink liquids of the plural colors and the reaction liquid from the droplet ejection heads in accordance with the dot data prepared by the preparation section.

A second aspect of the present invention is an inkjet recording device having: droplet ejection heads that respectively eject ink liquids of plural colors for recording dots at a recording medium; a preparation section that prepares dot data representing ejection amounts of the ink liquids of the plural colors for each dot, on the basis of gradation values of each pixel of an image represented by image data, the preparation section preparing the dot data such that ejection amounts of the ink liquids of the plural colors are respectively represented by data with a predetermined number of bits, and a number of bits of the dot data for one dot is an integer multiple of eight bits; and a control section that controls ejection of the ink liquids of the plural colors from the droplet ejection heads in accordance with the dot data prepared by the preparation section.

A third aspect of the invention is an inkjet recording device having: droplet ejection beads that respectively eject ink liquids of plural colors for recording dots at a recording medium; an acquisition section that acquires information relating to image recording; a preparation section that prepares dot data representing ejection amounts of the ink liquids of the plural colors for each dot, on the basis of gradation values of each pixel of an image represented by image data, the preparation section preparing the dot data such that ejection amounts of the ink liquids of the plural colors are respectively represented by data with proper numbers of bits on the basis of the information acquired by the acquisition section, and a number of bits of the dot data for one dot is an integer multiple of eight bits; and a control section that controls ejection of the ink liquids of the plural colors from the droplet ejection heads in accordance with the dot data prepared by the preparation section.

BRIEF DESCRIPTION OF THE DRAWINGS

Embodiments of the invention will be described in detail with reference to the following figures, wherein.

DETAILED DESCRIPTION OF THE INVENTION

Herebelow, embodiments of the present invention will be described in detail with reference to the drawings.

First Embodiment

Figure 1:
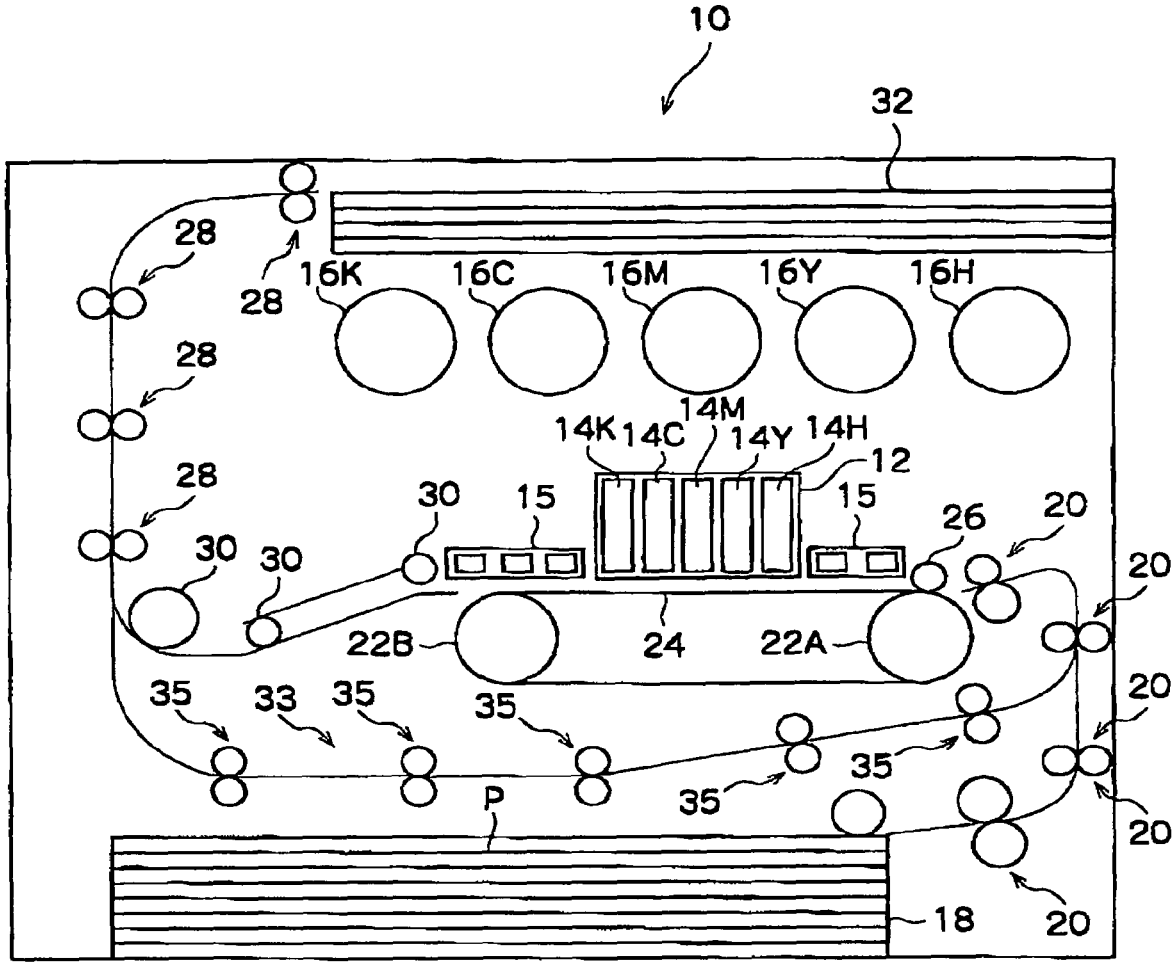
FIG. 1 is a schematic view showing structure of an inkjet recording device relating to a first embodiment.

FIG. 1 shows overall structure of an inkjet recording device 10 relating to the present embodiment;

The inkjet recording device 10 is equipped with a recording head array 12, which ejects ink liquids to record images. The recording head array 12 is structured by five droplet ejection heads 14C, 14M, 14Y, 14K and 14H, corresponding to the colors C (cyan), M (magenta), Y (yellow) and K (black) and a reaction liquid (H), which will be described later. Note that, in the following explanations, descriptions will be given with trailing letters corresponding to the respective colors appended to reference numerals when the respective colors are to be distinguished, and the trailing letters corresponding to the respective colors being omitted where the colors are not to be particularly distinguished.

Here, the reaction liquid is an ink which is colorless or a light (pale) color, containing a polyvalent metal or the like, and effects for causing dye of each of the C, M, Y, K color inks to coagulate, to reduce smearing of dots (running of the inks). When this reaction liquid is dropped as droplets in superposition with the inks of the respective colors, running of the inks is reduced and image quality can be improved. Note that the reaction liquid is not limited thus, and can be anything which causes some reaction to occur at the ink liquids.

Each droplet ejection head 14 is formed as a longitudinal head, a recording region of which is over at least the width of a recording paper P. Nozzles of the droplet ejection head 14 are arranged along the width direction of the recording paper P, and the droplet ejection head 14 is structured to record over the whole width of the recording paper P in one pass by ejecting ink droplets from the nozzles.

Ink tanks 16C, 16M, 16Y, 16K and 16H are provided to correspond with the respective droplet ejection heads 14. Ink liquids stored in the ink tanks 16 pass through not-illustrated piping and are supplied to the droplet ejection heads 14 of the corresponding colors.

In the vicinity of the recording head array 12, maintenance units 15 are provided to correspond with the droplet ejection heads 14. The maintenance units 15 perform cleaning for preventing blockages of the inks of the droplet ejection heads 14, suction recovery operations when ink blockages do occur, and suchlike.

Figure 2:
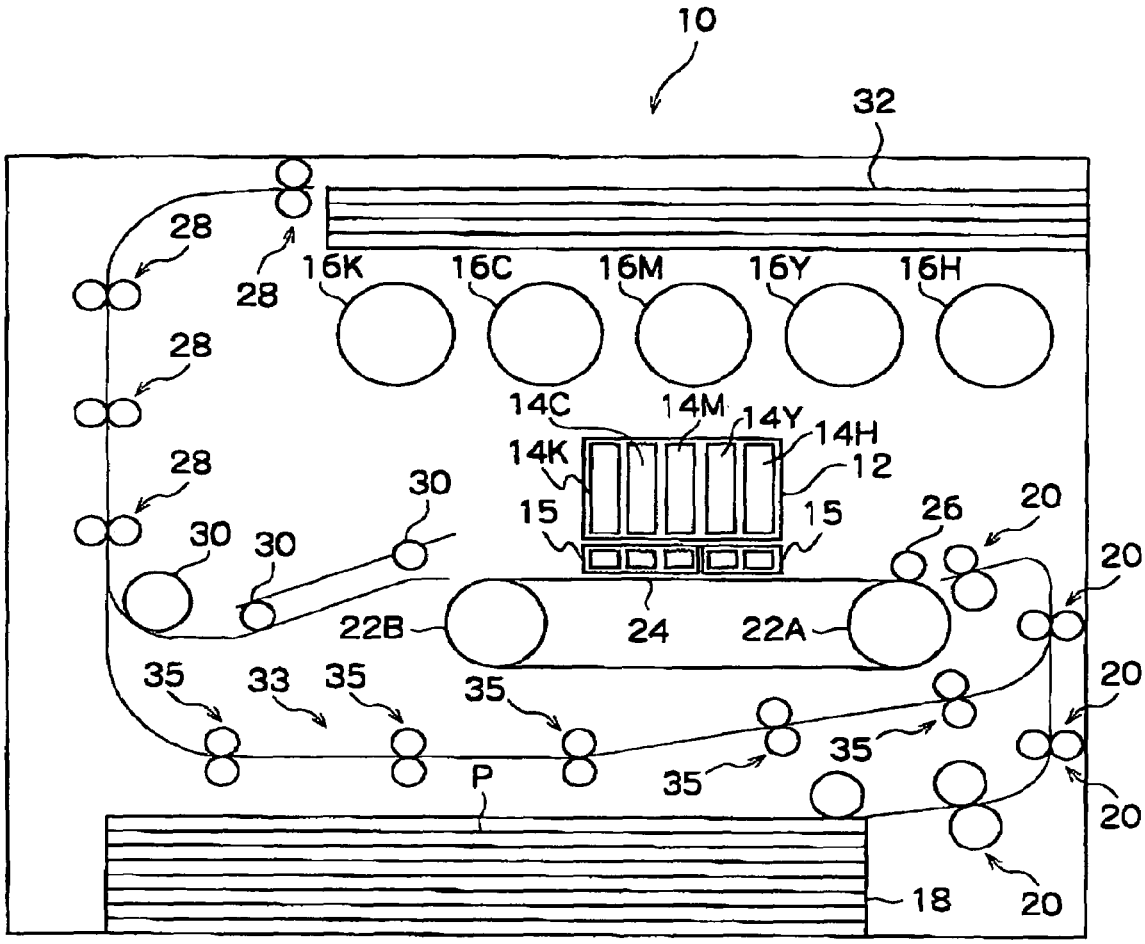
FIG. 2 is a schematic view showing structure of a configuration at a time of maintenance of the inkjet recording device relating to the first embodiment.

The maintenance units 15 are structured such that, at a time of image-recording, the maintenance units 15 are disposed at two sides of the recording head array 12, as shown in FIG. 1, and at a time of maintenance, the maintenance units 15 move to positions opposing the respective nozzles of the recording head array 12, as shown in FIG. 2. Note that structure of the maintenance units 15 is not limited thus; other structures are possible as long as it is possible to dispose the maintenance units IS to be capable of opposing the respective nozzles of the recording head array 12.

The inkjet recording device 10 is also provided with a paper supply tray 18, which stores the recording paper P. Recording paper P which is supplied from the paper supply tray 18 is conveyed by plural roller pairs 20 and is supplied to the recording head array 12. An endless belt-form conveyance body 24, which is wound round rollers 22A and 22B, is provided at a position opposing the recording head array 12. The endless belt-form conveyance body 24 is turned by rotation of the rollers 22A and 22B, and the recording paper P which has been conveyed thereto by the plural roller pairs 20 is conveyed by the endless belt-form conveyance body 24 to a position opposing the recording head array 12.

An attraction-adherence roller 26 is provided at a position opposing the roller 22A. The attraction-adherence roller 26 applies electric charge to the recording paper P which has been conveyed thereto by the plural roller pairs 20, and presses the recording paper P against the endless belt-form conveyance body 24. Thus, the recording paper P is attractively adhered to the endless belt-form conveyance body 24.

At a downstream side of the endless belt-form conveyance body 24 in the conveyance direction of the recording paper P, plural roller pairs 28 and conveyance rollers 30 are provided. Recording paper P at which an image has been recorded by the recording head array 12 is conveyed by these plural roller pairs 28 and conveyance rollers 30, and is ejected to an ejection tray 32.

The inkjet recording device 10 is also provided with an inversion path 33 for duplex printing. The inversion path 33 is structured by plural roller pairs 35. Recording paper P at one side of which an image has been recorded by the recording head array 12 is inverted by the inversion path 33 and conveyed to the position opposing the recording head array 12 again. Thus, it is possible to record images at both sides of the recording paper P.

Figure 3:
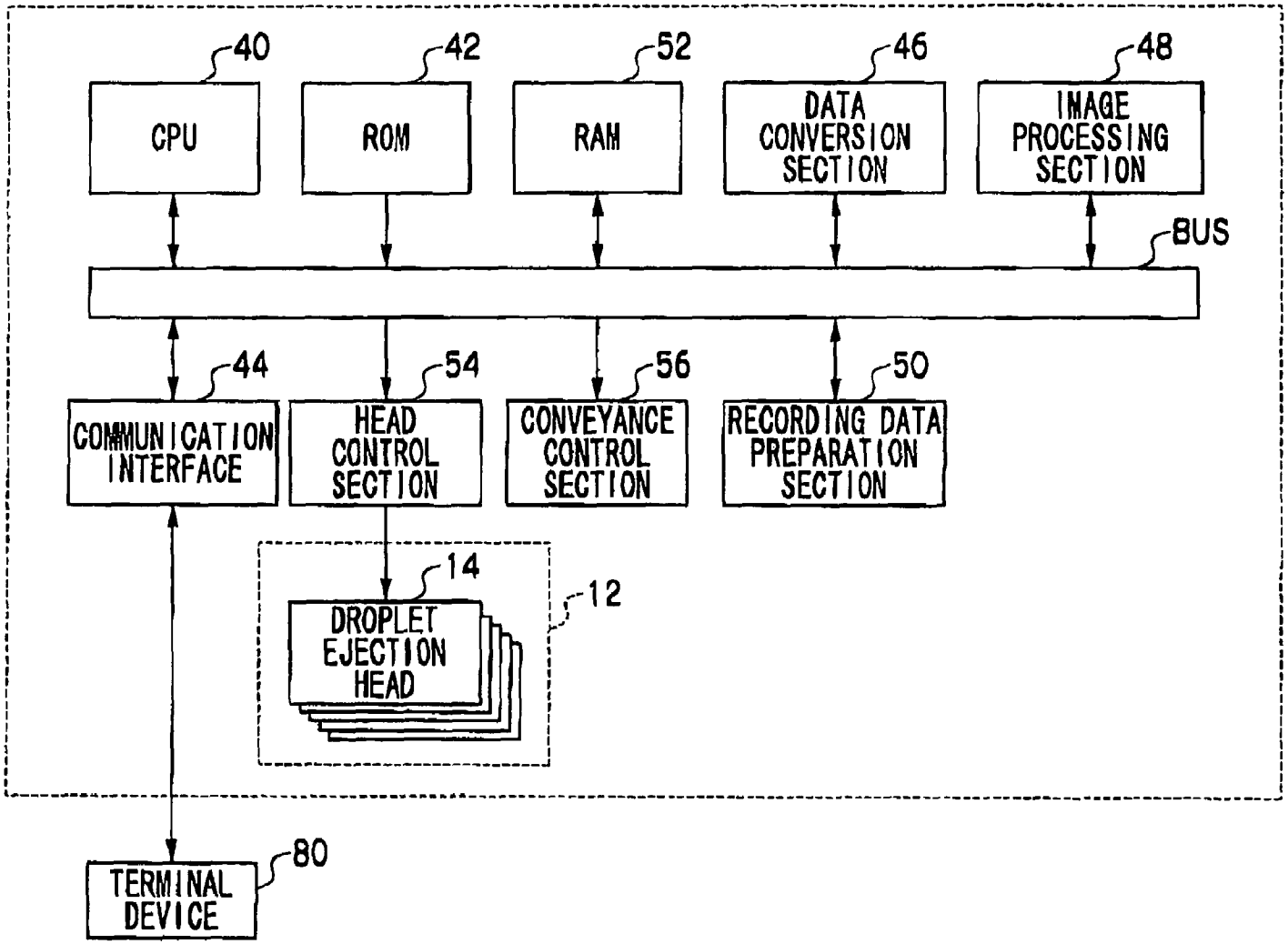
FIG. 3 shows structure of an electronic system of the inkjet recording device relating to the first embodiment.

FIG. 3 shows structure of an electronic system of the inkjet recording device 10 relating to the present embodiment.

The inkjet recording device 10 is provided with a CPU (central processing unit) 40, a ROM 42, a communication interface 44, a data conversion section 46 and an image processing section 48. The CPU 40 handles overall operations of the inkjet recording device 10. Various programs and various parameters and the like, including a control program for controlling the device as a whole and a later-described recording control processing program, are preparatorily memorized at the ROM 42. The communication interface 44 connects with a terminal device 80 via an unillustrated communication medium such as a network or the like, and receives image data to be recorded at the recording paper P from the terminal device 80. The data conversion section 46 converts received image data to C, M, Y, K color image data. The image processing section 48 prepares dot data with predetermined numbers of gradations for each of dots structuring pixels, by halftone processing or the like of comparatively highly gradated data of, for example, 256 levels or the like.

Here, an LUT (look-up table) for color correction is stored at the data conversion section 46. The data conversion section 46 converts the image data to C, M, Y, K image data and performs color correction processing, for color correction, density correction and the like, in accordance with characteristics of the inks.

At the image processing section 48, it is possible to utilize, for example, dithering, error diffusion or the like as a method for halftone processing for recording dots that structure pixels. The halftone processing is performed for each of the colors Y, M, C and K.

The inkjet recording device 10 is further equipped with a recording data preparation section 50, RAM 52, a head control section 54 and a conveyance control section 56. The recording data preparation section 50 prepares recording data, based on the dot data prepared by the image processing section 48, in which ejection amounts of ink at the respective nozzles of the respective droplet ejection heads 14 are set for recording the dots that structure the pixels. The RAM 52 temporarily stores the prepared recording data, and various other data and the like. The head control section 54 reads in the recording data stored at the RAM 52 and controls outputs of driving signals to piezoelectric elements which correspond with the respective nozzles of the droplet ejection heads 14. The conveyance control section 56 controls a not-illustrated motor for driving to turn the rollers, to control transport of the recording paper P.

Here, the recording data preparation section 50 converts the dot data to a data structure which can be read at the head control section 54 in consideration of arrangements of the respective nozzles of the respective droplet ejection heads 14, and stores C, M, Y, K, H recording data, in which the data is aligned with a sequence of recording to be read out from the head control section 54, at the RAM 52.

Further, the head control section 54 outputs individual driving signals to the piezoelectric elements corresponding with the respective nozzles of the droplet ejection heads 14 in accordance with the C, M, Y, K, H recording data, to control ejection amounts of the liquids to be ejected from the nozzles.

The CPU 40, ROM 42, RAM 52, data conversion section 46, image processing section 48, communication interface 44, head control section 54, conveyance control section 56 and recording data preparation section 50 are connected to one another via a system bus. Accordingly, the CPU 40 can implement each of access to the ROM 42 and the RAM 52, control of data processing by the data conversion section 46, the image processing section 48 and the recording data preparation section 50, and control of processing for recording to the recording paper P by control of the head control section 54 and the conveyance control section 56.

Now, at an ordinary droplet ejection head, it is possible to record dots with a number of gradations of from 2 to 8 levels by controlling ejection amounts of ink liquids to be ejected from nozzles. At the droplet ejection head 14 relating to the present embodiment however, it is possible to perform recording with four levels for each color for each dot by controlling ejection amounts of the ink liquids to be ejected from the nozzles to "large droplet", "medium droplet", "small droplet" and "nothing".

Figure 4:
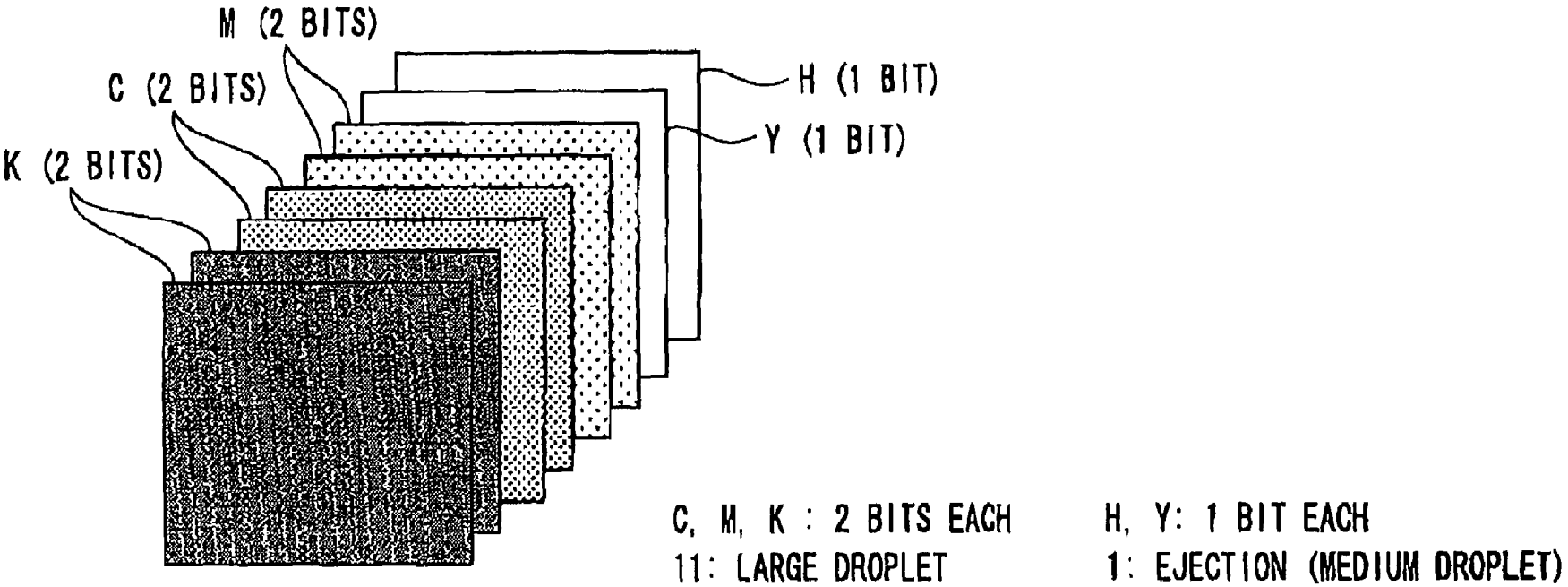
FIG. 4 is a schematic diagram showing the constitution of dot data corresponding to one dot in relation to the first aspect.

Therefore, for dot data relating to the present embodiment, as shown in FIG. 4, data for a dot is formed as data with four gradation levels (two bits) for each of the colors C, M and K. Further, because visibility of the color Y is relatively low in comparison with the colors C, M and K, in the data for a dot, data of Y is simplified to data with two gradation levels (1 bit) (i.e., ejection/non-ejection).

Further, at the inkjet recording device 10, the reaction liquid is ejected to be superposed with dot at which any of the colors C, M, Y and K is recorded. Thus, the dot data includes data of two levels (1 bit) (i.e., ejection/non-ejection) for the reaction liquid at each dot.

That is, the image processing section 48 prepares dot data with a total data amount of 8 bits (1 byte): 2 bits for each of the colors C, M and K, and 1 bit for each of the color Y and the reaction liquid, for a single dot.

Next, operation of the recording control processing program, which is executed when an image is to be recorded, will be described with reference to FIG. 5. Here, FIG. 5 is a flowchart showing flow of the recording control processing program, which program is stored beforehand at a predetermined region of the ROM 42 and is executed when image data is received by the communication interface 44 from the terminal device 80 via the communication medium.

Figure 5:
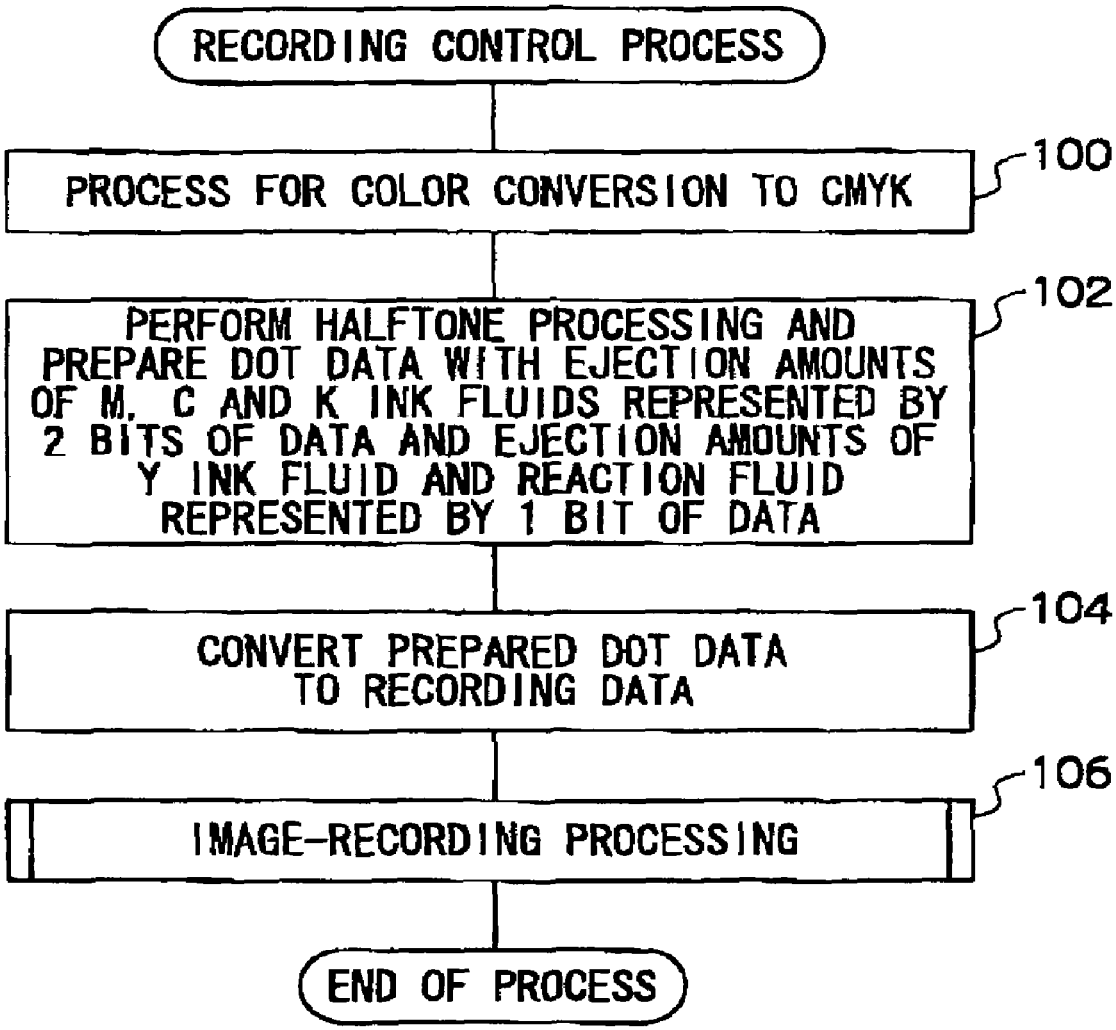
FIG. 5 is a flowchart showing flow of a recording control process relating to the first aspect.

In step 100 of FIG. 5, the received image data is converted to C, M, Y, K image data, and color correction processing, such as color correction, density correction and the like, is performed in accordance with characteristics of the inks of each color, utilizing the color correction LUT.

In a next step 102, halftone processing is performed on the basis of the color-converted image data (C, M, Y and K image data), and, in accordance with gradation values of each pixel, dot data, of 2 bits for C, M and K, 1 bit for Y and 1 bit for the reaction liquid, is prepared for each dot.

In a next step 104, in consideration of the arrangements of the respective nozzles of the respective droplet ejection beads 14, the dot data is converted to C, M, Y, K, H recording data and stored at the RAM 52.

In a next step 106, as image-recording processing, the not-illustrated motor is controlled by the conveyance control section 56, conveyance of the recording paper P stored at the paper supply tray 18 is commenced, and the recording paper P is supplied to the recording head array 12. Hence, synchronously with conveyance of the recording paper P by the endless belt-form conveyance body 24 at the position opposing the recording head array 12, the C, M, Y, K, H recording data is read in by the head control section 54, driving signals are sequentially outputted to the piezoelectric elements corresponding with the nozzles of the droplet ejection heads 14, the ink liquids and the reaction liquid are ejected from the nozzles of the respective droplet ejection heads 14, and an image is recorded at the recording paper P. The recording paper P at which the image has been recorded is conveyed by the plural roller pairs 28 and the conveyance rollers 30, and ejected to the ejection tray 32. Thus, this recording control process is completed.

Thus, according to the first embodiment, ejection amounts of the yellow ink liquid and the reaction liquid for each dot are represented by 1 bit in the dot data. As a result, the dot data can be accommodated with a size the same as in a case of a data size of 2 bits for each of the four colors Y, M, C and K, and it is possible to reduce data volumes to 4/5 without a significant reduction in quality of images. Furthermore, because the data amount for each dot is an 8-bit unit, this constitution is appropriate for digital processing, management of memory space, data transfer with the system bus, etc.

According to the first embodiment as described above, the droplet ejection heads are provided to eject the ink liquids of plural colors and the reaction liquid, which causes the predetermined reaction to occur at the ink liquids, and record dots at the recording medium. A preparation section (here, the image processing section 48) prepares dot data representing ejection amounts of the ink liquids of the plural colors and the reaction liquid for each dot on the basis of gradation values for each pixel of an image represented by image data. The preparation section represents ejection amounts of the ink liquids of colors of a subset of the plural colors, which arc high in visibility, by data with a respective predetermined number of bits, and represents ejection amounts of the reaction liquid and the rest of the plural colors by data with a smaller number of bits than the respective predetermined number of bits. Thus, the preparation section prepares the dot data such that the number of bits of the dot data for one dot is an integer multiple of 8 bits. A control section (here, the CPU 40) performs control to eject the ink liquids of the plural colors and the reaction liquid from the droplet ejection heads in accordance with the dot data prepared by the preparation section. Thus, it is possible both to restrain a deterioration in quality of the image to be recorded based on the dot data and to carry out digital processing on respective dots of the dot data with ease.

Furthermore, according to the first embodiment, the ink liquids of the plural colors are ink liquids of the colors cyan, magenta, yellow and black, the subset of the plural colors is cyan, magenta and black, and the rest of the plural colors is yellow. Therefore, it is possible to record color images In addition, by setting the ejection amounts for yellow to data with a number of bits which is smaller than the predetermined number of bits, it is possible to keep a deterioration in image quality small.

Now, for the first embodiment, descriptions have been given for a case in which the number of bits in the dot data for each dot of the colors C, M and K is 2 bits (four levels). However, the present invention is not limited thus. For example, any number of bits which is a power of 2 is possible. Further, the numbers of bits in the dot data for yellow and the reaction liquid may have more numerous levels (plural bits), as long as the numbers of bits are smaller than the numbers of bits for the colors C, M and K for each dot. For example, if the number of bits for each dot for each of the colors C, M and K is 4 bits and the numbers of bits for yellow and the reaction liquid are 2 bits, the total number of bits for each dot is 16 bits (2 bytes), which is an integer multiple of 8 bits. Therefore, such a constitution is appropriate for digital processing, administration of memory space, data transfer with the system bus and so forth.

Further yet, for the first embodiment, descriptions have been given for a case in which, of the colored inks for recording images, the number of bits of data for each dot of the color Y is set to 1 bit. However, the present invention is not limited thus. For example, it is possible for the inkjet recording device 10 to have colored inks of five, six or more colors for recording images, and to employ a constitution in which the numbers of bits of data for each dot are made smaller for a plural colors of inks which are low in visibility

Second Embodiment

For a second embodiment, an example will be described in which ordinary paper and/or glossy paper is stored at the paper supply tray 18 to serve as the recording paper P. The surface of the glossy paper has a particular coating such that ink does not run, for recording images of higher quality. When a user designates recording to glossy paper as a condition at a time of recording, image-recording processing is carried out without the reaction liquid being superposingly ejected. Note that structure of the inkjet recording device 10 relating to the second embodiment is similar to that in FIGS. 1 to 3, and descriptions thereof will not be given here.

After ordinary paper or glossy paper has been stored at the paper supply tray 18 of the inkjet recording device 10, from the terminal device 80 relating to the second embodiment, a user selects whether an image represented by image data is to be recorded at ordinary paper or recorded at glossy paper. The terminal device 80 transmits image data which is designated for recording and this selection information through the communication medium.

The inkjet recording device 10 acquires the image data together with the selection information via the communication interface 44, and carries out image-recording processing.

Figure 6:
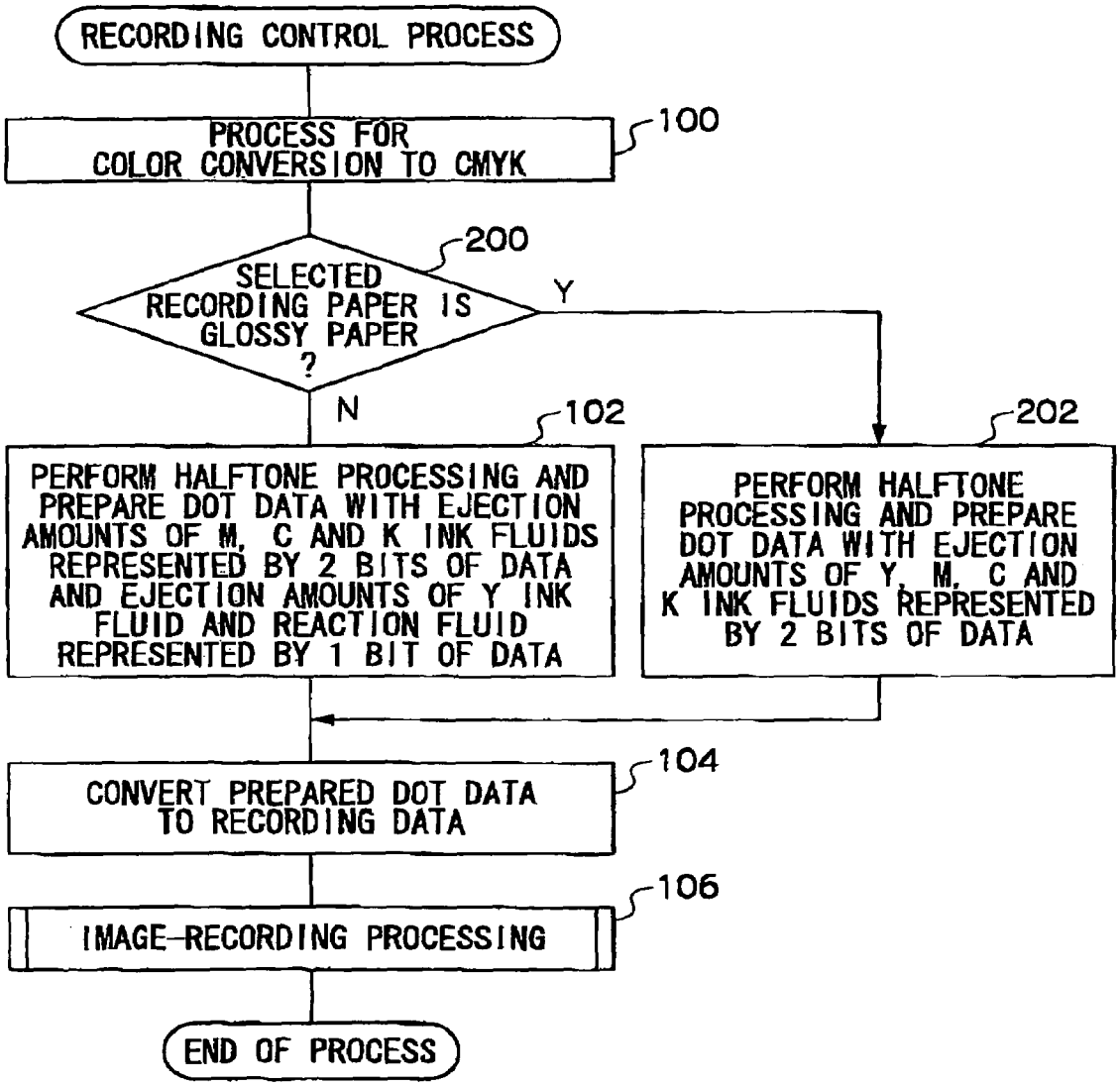
FIG. 6 is a flowchart showing flow of a recording control process relating to a second aspect.

FIG. 6 shows a flowchart representing flow of a recording control process relating to the second embodiment. Note that processing that is the same as in the recording control process relating to the first embodiment (see FIG. 5) is assigned the same step numbers, and descriptions thereof are not given here.

In step 200 of FIG. 6, it is determined, based on the selection information, whether or not the selected recording paper P is glossy paper. If this determination is positive, the process advances to step 202, but if the determination is negative, the process advances to step 102.

In step 202, halftone processing is performed on the basis of image data which has been color-converted to the colors C, M, Y and K. In accordance with the gradation values for each pixel, dot data with two bits for the colors Y, C, M and K is prepared for each dot, and the process advances to step 104.

Figure 7:
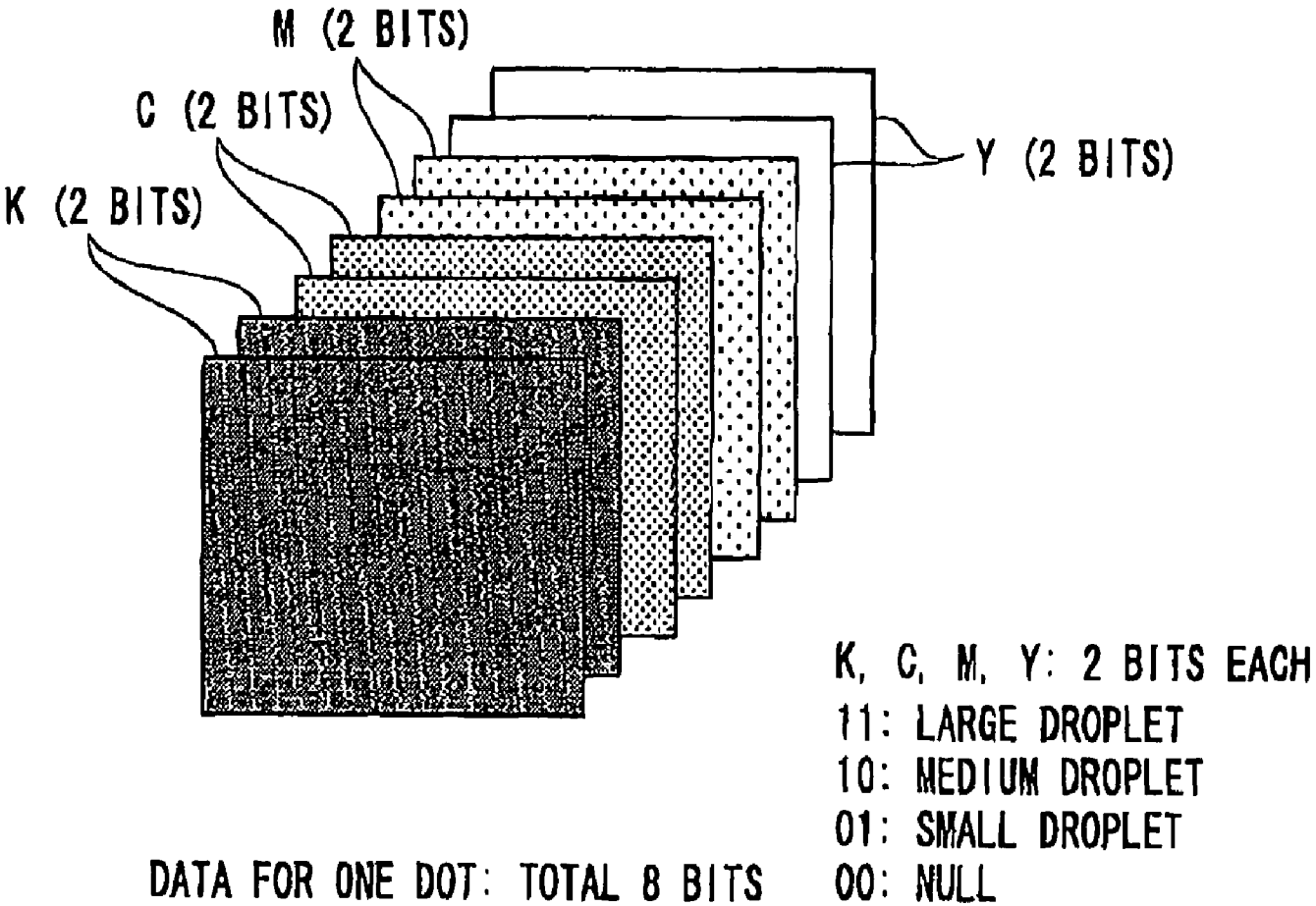
FIG. 7 is a schematic diagram showing the constitution of dot data corresponding to one dot in relation to the second aspect.

Consequently, in the dot data relating to the present embodiment, the data corresponding to each dot is data with 4 gradations (2 bits) for each of the colors Y, C, M and K, as shown in FIG. 7.

Thus, according to the second embodiment, at the inkjet recording device 10 which is equipped with the reaction liquid, in a case in which superposing ejection of the reaction liquid is not required, the Y data for each dot in the dot data is set to 2 bits, the same as for C, M and K. Therefore, images can be recorded without a deterioration of image quality.

According to the second embodiment as described above, an acquisition section (here, the communication interface 44) acquires selection information representing an instruction selecting either one of a reaction liquid usage mode, in which the ink liquids of the plural colors and the reaction liquid are ejected from the droplet ejection heads for recording an image, and a reaction liquid non-usage mode, in which only the ink liquids of the plural colors are ejected for recording an image. When the reaction liquid non-usage mode is selected according to the selection information acquired by the acquisition section, the preparation section (here, the image processing section 48) prepares data in which ejection amounts of the fluid ink of the aforementioned rest color of the plurality of colors (see the first embodiment) are represented by the aforementioned predetermined number of bits (see the first embodiment). Therefore, image quality will not deteriorate when an image is recorded without ejecting the reaction liquid.

Figure 8:
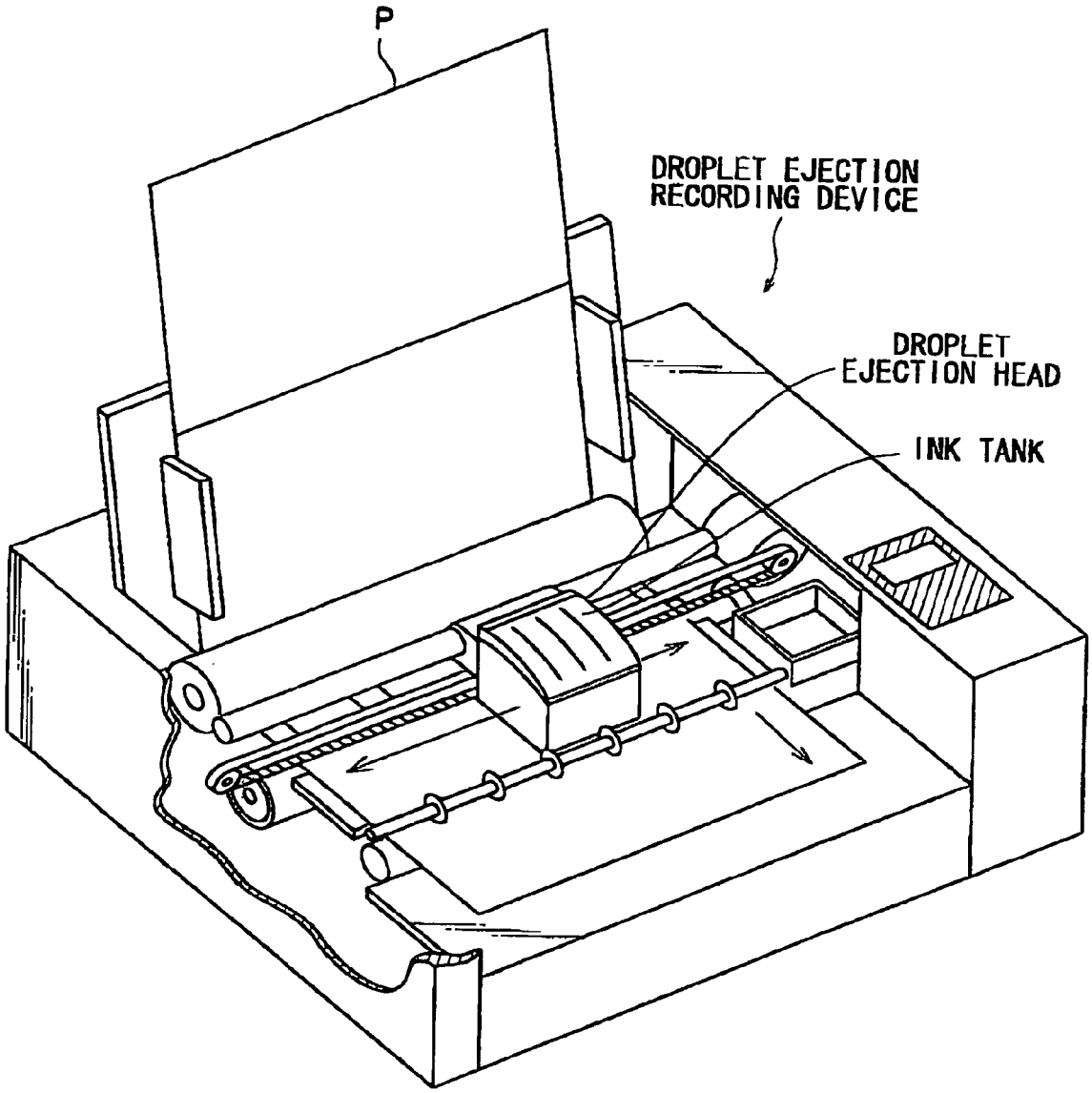
FIG. 8 is a schematic view showing another structure of an inkjet recording device.

Anyway, for the first and second embodiments, cases have been described of structures in which the droplet ejection heads 14 are formed as long, narrow (longitudinal) heads over at least the width of the recording paper P and record over the whole width of the recording paper P at one time. However, the present invention is not limited thus. For example, it is also possible to apply the present invention to an inkjet recording device in which nozzles corresponding to the ink liquids of the respective colors and the reaction liquid are arranged in a droplet ejection head, which is moved in the width direction of the recording paper P to perform recording in the width direction, as shown in FIG. 8. An image is recorded by reciprocatingly moving the droplet ejection head in the width direction of the recording paper P while the recording paper P is conveyed. In such a case too, the same effects can be achieved as with the present embodiments.

Figure 9:
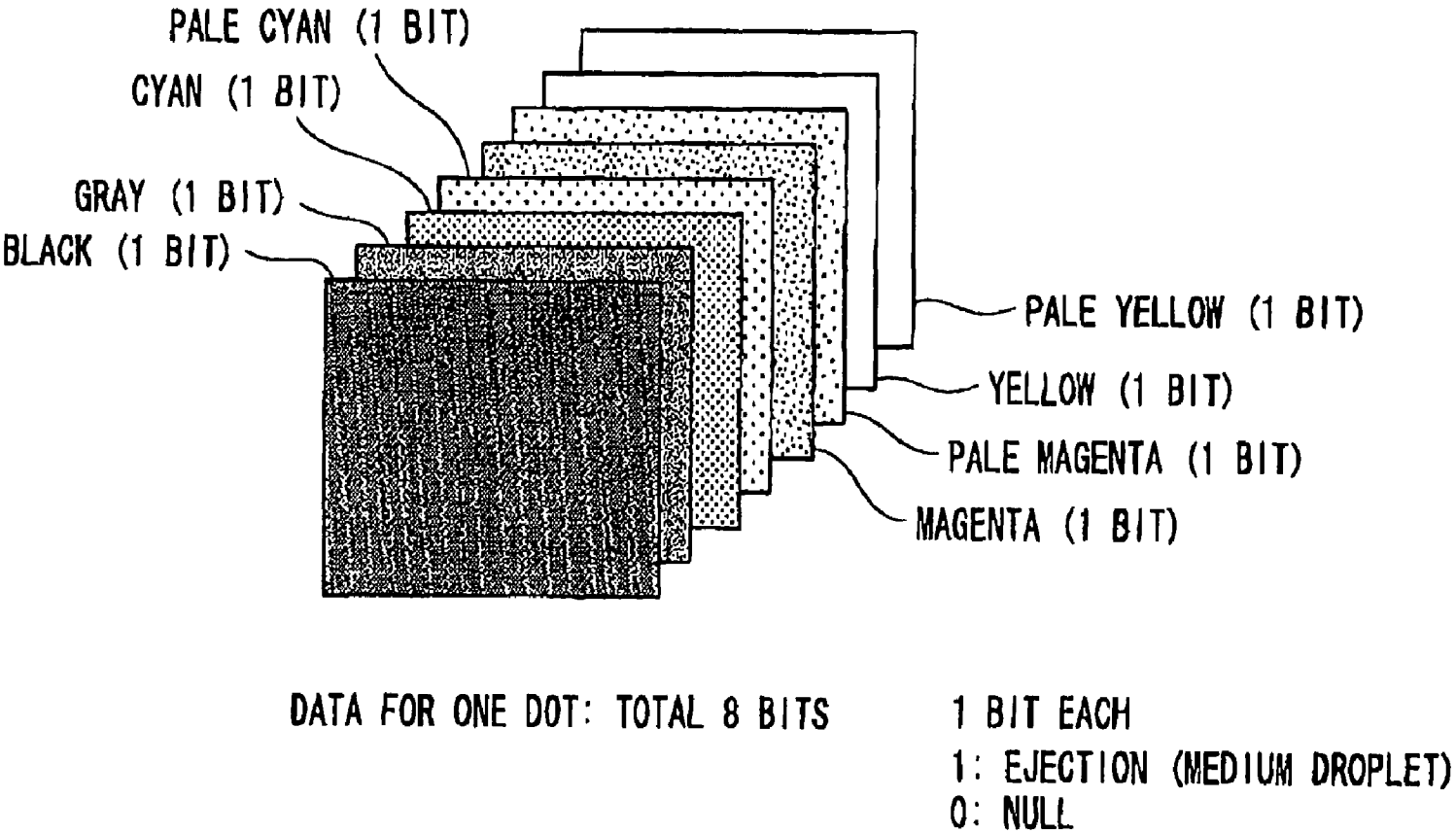
FIG. 9 is a schematic diagram showing the constitution of dot data corresponding to one dot in an inkjet recording device which employs ink liquids of the colors C, M, Y and K and pale colors.

Further, at, for example, the inkjet recording device as shown in FIG. 8, it is possible to add/substitute ink tanks in which ink liquids of light (pale) colors (light cyan, light magenta, light yellow and gray) are stored in place of an ink tank at which the reaction liquid is stored. Hence, it is possible to eject the pale colors corresponding to the respective colors C, M, Y and K from the droplet ejection head in addition to the colors C, M, Y and K. In such a case, as shown in FIG. 9, ejection values of the ink liquids of the colors C, M, Y and K and the respective pale colors may be represented by single bits of data, with the number of bits of dot data for each dot being set to a unit of eight bits. Accordingly, data volume of the dot data will not be increased even in a case in which the pale color inks are added.

Further still, for the second embodiment, a case in which the selection information is acquired via the communication interface 44 has been described., but the present invention is not limited thus. For example, a case is also possible in which an instruction panel for selecting whether the recording paper P is ordinary paper or glossy paper is provided at the inkjet recording device 10, and the selection information is acquired from this selection panel by the user In the second embodiment, the selection information is information for selecting one of an ordinary paper or a glossy paper as the recording paper P, that is, information which represents an instruction selecting either one of a reaction liquid usage mode, in which the ink liquids of the plurality of colors and the reaction liquid are ejected from the droplet ejection heads for recording an image, and a reaction liquid non-usage mode, in which only the ink liquids of the plurality of colors are ejected for recording an image. However, the present invention is not limited thus. For example, a case is also possible in which the selection information is information relating to image recording, for example, information relating to at least one of the recording paper P and quality (desired quality) of image recorded on the recording paper P. Further, in the embodiments mentioned above, a case is also possible in which, on the basis of the information mentioned above, dot data is set (changed) such that ejection amounts of the ink liquids of the plurality of colors, or ejection amounts of the ink liquids of the plurality of colors and the reaction liquid, are respectively represented by data with respective proper numbers of bits and a number of bits of the dot data for one dot is an integer multiple of eight bits.

In addition, the structure of the inkjet recording device 10 described for the first and second embodiments (see FIGS. 1 to 3) is an example and, obviously, suitable modifications can be made within a scope not departing from the spirit of the present invention.

Moreover, the flows of recording control processing described for the present embodiments (see FIGS. 5 and 6) are also examples and, obviously, suitable modifications can be made within a scope not departing from the spirit of the present invention.

What is claimed is:

1. An inkjet recording device comprising:

droplet ejection heads that respectively eject ink liquids of a plurality of colors and a reaction liquid that causes coloring material of the ink liquid to coagulate, for recording dots at a recording medium;

a preparation section that prepares dot data representing ejection amounts of the ink liquids of the plurality of colors and the reaction liquid for each dot, on the basis of gradation values of each pixel of an image represented by image data, the preparation section preparing the dot data such that ejection amounts of the ink liquids of colors among the plurality of colors, each of the ink liquids of the colors being high in visibility, are respectively represented by data with a predetermined number of bits, ejection amounts of the reaction liquid and the ink liquid of the rest of the plurality of colors are respectively represented by data with a number of bits which is smaller than the predetermined number of bits, and a number of bits of the dot data for one dot is an integer multiple of eight bits, the number of bits of the dot data for one dot being a sum of:

(i) a sum of the predetermined number of bits representing the ejection amounts of the ink liquids of colors among the plurality of colors being high in visibility, and (ii) a sum of the number of bits which are smaller than the predetermined number of bits representing the ejection amounts of the reaction and the ink liquid of the rest of the plurality of colors; and a control section that controls ejection of the ink liquids of the plurality of colors and the reaction liquid from the droplet ejection heads in accordance with the dot data prepared by the preparation section.

2. The inkjet recording device of claim 1, further comprising an acquisition section, that acquires selection information which represents an instruction selecting either one of a reaction liquid usage mode, in which the ink liquids of the plurality of colors and the reaction liquid are ejected from the droplet ejection heads for recording an image, and a reaction liquid non-usage mode, in which only the ink liquids of the plurality of colors are ejected for recording an image, wherein, when the reaction liquid non-usage mode is selected according to the selection information acquired by the acquisition section, the preparation section prepares dot data in which the ejection amount of the ink liquid of the rest of the plurality of colors is represented by data with the predetermined number of bits.

3. The inkjet recording device of claim 1, wherein the ink liquids of the plurality of colors are ink liquids of the colors cyan, magenta, yellow and black, the ink liquids of the colors among the plurality of colors being high in visibility, are cyan, magenta and black, and the ink liquid of the rest of the plurality of colors is yellow.

4. The inkjet recording device of claim 1, wherein the predetermined number of bits is a number of bits which is a power of 2.

5. The inkjet recording device of claim 2, wherein the ink liquids of the plurality of colors are ink liquids of the colors cyan, magenta, yellow and black, the ink liquids of the colors among the plurality of colors being high in visibility, are cyan, magenta and black, and the ink liquid of the rest of the plurality of colors is yellow.

6. The inkjet recording device of claim 2, wherein the predetermined number of bits is a number of bits which is a power of 2.

7. An inkjet recording device comprising:

droplet ejection heads that respectively eject ink liquids of a plurality of colors for recording dots at a recording medium;

a droplet ejection head that ejects a reaction liquid that causes coloring material of the ink liquid to coagulate;

an acquisition section that acquires information relating to image recording, wherein the information relating to image recording relates to at least one of the recording medium and quality of the image recorded on the recording medium;

a preparation section that prepares dot data representing ejection amounts of the ink liquids of the plurality of colors and the reaction liquid for each dot, on the basis of gradation values of each pixel of an image represented by image data, the preparation section preparing the dot data such that ejection amounts of the ink liquids of the plurality of colors and the reaction liquid are respectively represented by data with numbers of bits on the basis of the information acquired by the acquisition section, and in a case of using the reaction liquid when recording on the basis of the acquired information relating to image recording, a number of bits of the dot data for one dot is an integer multiple of eight bits, the number of bits of the dot data for one dot being a sum of the number of bits representing the ejection amounts of the ink liquids of the plurality of colors and the reaction liquid; and a control section that controls ejection of the ink liquids of the plurality of colors and the reaction liquid from the droplet ejection heads in accordance with the dot data prepared by the preparation section.

8. The inkjet recording device of claim 7, wherein the preparation section preparing the dot data such that ejection amounts of the ink liquids of colors among the plurality of colors, each of the ink liquids of the colors being high in visibility, are respectively represented by data with a predetermined number of bits, and ejection amounts of the reaction liquid and the ink liquid of the rest of the plurality of colors are respectively represented by data with a number of bits which is smaller than the predetermined number of bits.

9. An inkjet recording device comprising:

droplet ejection heads that respectively eject ink liquids of a plurality of colors and a reaction liquid that causes coloring material of the ink liquid to coagulate, for recording dots at a recording medium;

a preparation section that prepares dot data representing ejection amounts of the ink liquids of the plurality of colors and the reaction liquid for each dot, on the basis of gradation values of each pixel of an image represented by image data, the preparation section preparing the dot data such that ejection amounts of the ink liquids of the plurality of colors are respectively represented by data with a predetermined numbers of bits, ejection amount of the reaction liquid is represented by data with a number of bits which is smaller than the predetermined number of bits, and a number of bits of the dot data for one dot is an integer multiple of eight bits, the number of bits of the dot data for one dot being a sum of (i) a sum of the predetermined number of bits representing the ejection amounts of the plurality of colors, and (ii) a sum of the number of bits which is smaller than the predetermined number of bits representing the ejection amount of the reaction liquid; and a control section that controls ejection of the ink liquids of the plurality of colors and the reaction liquid from the droplet ejection heads in accordance with the dot data prepared by the preparation section.

* * * * *